US011771956B2

(12) United States Patent
Youn

(10) Patent No.: US 11,771,956 B2
(45) Date of Patent: Oct. 3, 2023

(54) SWING ANALYSIS DEVICE

(71) Applicant: Swing Logic Ventures, Inc., Edmond, OK (US)

(72) Inventor: Jong Sang Youn, Seongnam-si (KR)

(73) Assignee: Swing Logic Ventures, Inc., Edmond, OK (US)

( * ) Notice: Subject to any disclaimer, the term of this patent is extended or adjusted under 35 U.S.C. 154(b) by 0 days.

(21) Appl. No.: 17/702,210

(22) Filed: Mar. 23, 2022

(65) Prior Publication Data

US 2022/0331657 A1 Oct. 20, 2022

(30) Foreign Application Priority Data

Apr. 19, 2021 (KR) ..... 10-2021-0050654

(51) Int. Cl.
*A63B 69/36* (2006.01)
*A63B 24/00* (2006.01)
*A63B 71/06* (2006.01)

(52) U.S. Cl.
CPC ..... *A63B 24/0006* (2013.01); *A63B 24/0021* (2013.01); *A63B 69/3632* (2013.01); *A63B 71/0622* (2013.01); *A63B 2024/0034* (2013.01); *A63B 2024/0056* (2013.01); *A63B 2071/065* (2013.01); *A63B 2220/833* (2013.01); *A63B 2225/02* (2013.01); *A63B 2225/50* (2013.01)

(58) Field of Classification Search
CPC ..... A63B 24/0006; A63B 24/0021; A63B 69/3632; A63B 71/0622; A63B 2024/0034; A63B 2024/0056; A63B 2071/065; A63B 2220/833; A63B 2225/02; A63B 2225/50; A63B 2220/803
USPC ..... 473/223, 453
See application file for complete search history.

(56) References Cited

U.S. PATENT DOCUMENTS 8,672,779 B1 * 3/2014 Sakyo ..... G06V 40/23 473/223
2012/0179418 A1 * 7/2012 Takasugi ..... G01P 3/00 702/151
2014/0106892 A1 * 4/2014 Lin ..... G09B 19/0038 473/223
2014/0200094 A1 * 7/2014 Parke ..... G06V 40/23 473/409

(Continued)

FOREIGN PATENT DOCUMENTS

KR 10-0818169 B1 4/2008

*Primary Examiner* — Nini F Legesse
(74) *Attorney, Agent, or Firm* — Bridgeway IP Law Group, PLLC; Jihun Kim

(57) ABSTRACT

Proposed is a swing analysis device which includes a measurement unit which is coupled to a golf club of a user, and is configured to continuously measure motion data during swing motions of the golf club, an analysis unit configured to analyze the motion data continuously measured by the measurement unit to generate a swing analysis value, and a communication unit configured to transmit the swing analysis value generated by the analysis unit to a user terminal. According to the swing analysis device, as a swing analysis value generated based on motion data of the golf club is transmitted to a user terminal, the swing analysis value can be directly output by an application program installed in the user terminal without analyzing the motion data thus to greatly improve the reaction speed of the application program.

3 Claims, 3 Drawing Sheets

(56) References Cited

U.S. PATENT DOCUMENTS

| | | | | |
|---|---|---|---|---|
| 2014/0228141 | A1* | 8/2014 | Sakyo | A63B 69/3623 473/409 |
| 2015/0111657 | A1* | 4/2015 | Shibuya | G06V 40/23 473/409 |
| 2015/0119158 | A1* | 4/2015 | Sato | A63B 69/3632 473/223 |
| 2016/0074703 | A1* | 3/2016 | Shibuya | G16H 20/30 473/409 |
| 2017/0239520 | A1* | 8/2017 | Kodaira | A61B 5/744 |
| 2018/0021653 | A1* | 1/2018 | Thornbrue | A63B 69/3635 473/453 |
| 2018/0221711 | A1* | 8/2018 | Shibuya | A63B 24/0006 |
| 2020/0306610 | A1* | 10/2020 | Kodaira | A63B 71/0619 |

* cited by examiner

SWING ANALYSIS DEVICE

CROSS REFERENCE TO RELATED APPLICATIONS

This application claims the priority benefit of Korean Patent Application No. 10-2021-0050654 filed on Apr. 19, 2021, the entirety of which is incorporated by reference herein.

BACKGROUND OF THE INVENTION

1. Field of the Invention

The present invention relates to a swing analysis device, and more particularly, to a device for analyzing a swing of a golf club, in which, not only as a swing analysis value generated based on motion data of the golf club is transmitted to a user terminal, the swing analysis value can be directly output by an application program installed in the user terminal without analyzing the motion data thus to greatly improve a reaction speed of the application program, but also as the swing analysis value can be generated based on calibration information received from the user terminal, the swing analysis device allows the user to receive very accurate swing analysis results.

2. Description of the Related Art

In order to analyze a golfer's swing, various types of swing analysis devices mounted on a golf club have been released. These conventional swing analysis devices known in the art are operated in a manner that a measurement value measured through an internal sensor module is transmitted to a user terminal such as a smartphone when performing a golf swing motion by a user.

Meanwhile, an application program installed in the user terminal analyzes the user's swing by analyzing the sensor measurement value received from the swing analysis device, and outputs a simulation image such as a movement trajectory of a ball generated based on the analysis results on a screen of the user terminal.

According to the prior art as described above, there is a problem in that a delay in a reaction speed of the application program occurs due to a computation load during analyzing the sensor measurement value by the application program installed in the user terminal.

In addition, due to limitations in the accuracy of the sensor module provided in the swing analysis device, a difference between a swing analysis value and an actual swing result value inevitably occurs in the art. However, the conventional swing analysis device has a technical limitation that such a difference cannot be corrected.

SUMMARY OF THE INVENTION

Accordingly, it is an object of the present invention to provide a swing analysis device, in which, not only as a swing analysis value generated based on motion data of the golf club is transmitted to a user terminal, the swing analysis value can be directly output by an application program installed in the user terminal without analyzing the motion data thus to greatly improve a reaction speed of the application program, but also as the swing analysis value can be generated based on calibration information received from the user terminal, the swing analysis device allows the user to receive very accurate swing analysis results.

To achieve the above object, according to an aspect of the present invention, there is provided a swing analysis device including: a measurement unit which is coupled to a golf club of a user, and is configured to continuously measure motion data during swing motions of the golf club; an analysis unit configured to analyze the motion data continuously measured by the measurement unit to generate a swing analysis value; and a communication unit configured to transmit the swing analysis value generated by the analysis unit to a user terminal.

Preferably, the analysis unit divides the swing motion of the golf club by each swing section based on the continuously measured motion data.

In addition, the analysis unit may analyze the motion data in an impact section among the divided swing sections.

Further, the swing analysis device may receive calibration information on the swing analysis value from the user terminal through the communication unit, which is input to the user terminal by a user who has confirmed the swing analysis value through the user terminal.

Furthermore, the analysis unit may generate the swing analysis value based on the calibration information.

According to the swing analysis device of the present invention, as a swing analysis value generated based on motion data of the golf club is transmitted to a user terminal, the swing analysis value can be directly output by an application program installed in the user terminal without analyzing the motion data thus to greatly improve the reaction speed of the application program.

In addition, according to the present invention, as the swing analysis value can be generated based on calibration information received from the user terminal, the swing analysis device allows the user to receive very accurate swing analysis results.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
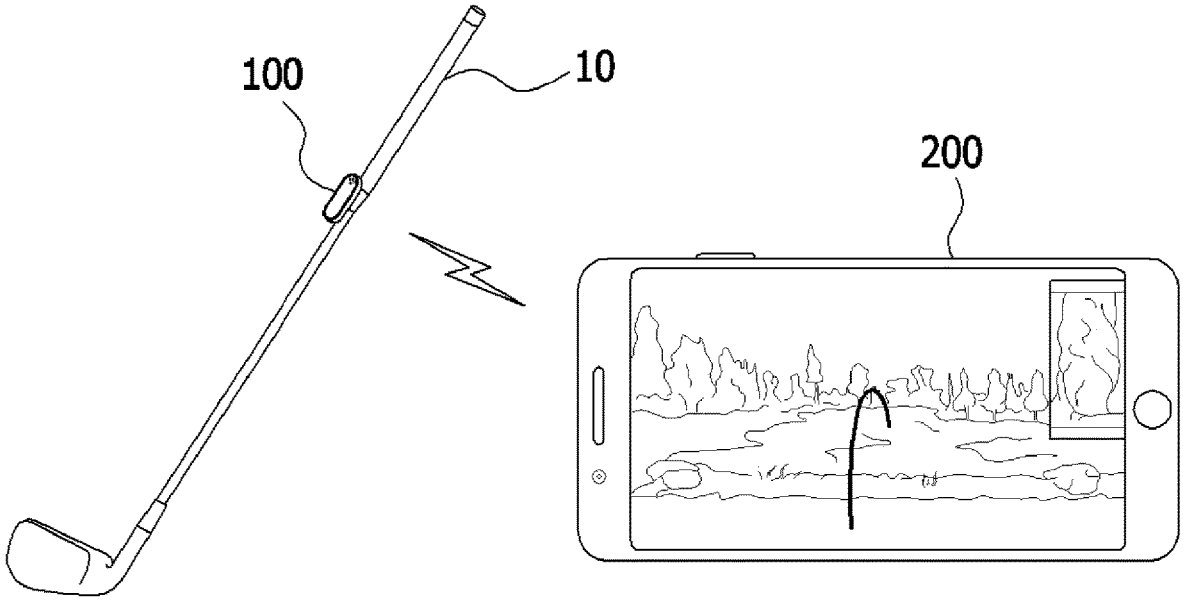
FIG. 1 is a view illustrating a usage environment of a swing analysis device according to an embodiment of the present invention.

Hereinafter, the present invention will be described with reference to the accompanying drawings in detail. Referring to the drawings, wherein like reference characters designate like or corresponding parts throughout the several views. In the embodiments of the present invention, the publicly known functions and configurations that are judged to be able to make the purport of the present invention unnecessarily obscure will not be described.

FIG. 1 is a view illustrating a usage environment of a swing analysis device according to an embodiment of the present invention. As shown in FIG. 1, a swing analysis device 100 according to an embodiment of the present invention is detachably installed on a golf club 10 of a user, and is configured to continuously measure motion data of the golf club 10 when the user swings the golf club 10, and generate a swing analysis value by analyzing the measured motion data.

Meanwhile, a user terminal 200 is a wireless communication terminal such as a smartphone carried by a user, and includes an application program installed therein, which is necessary for the use of the swing analysis device 100 according to an embodiment of the present invention.

The user terminal 200 receives a swing analysis value generated by self-analyzing motion data by the swing analysis device 100, from the swing analysis device 100.

As described above, in the present invention, the swing analysis value received from the swing analysis device 100 can be output by the application program installed in the user terminal 200 without performing a process of directly analyzing the motion data, thereby greatly improving a reaction speed of the application program.

Figure 2:
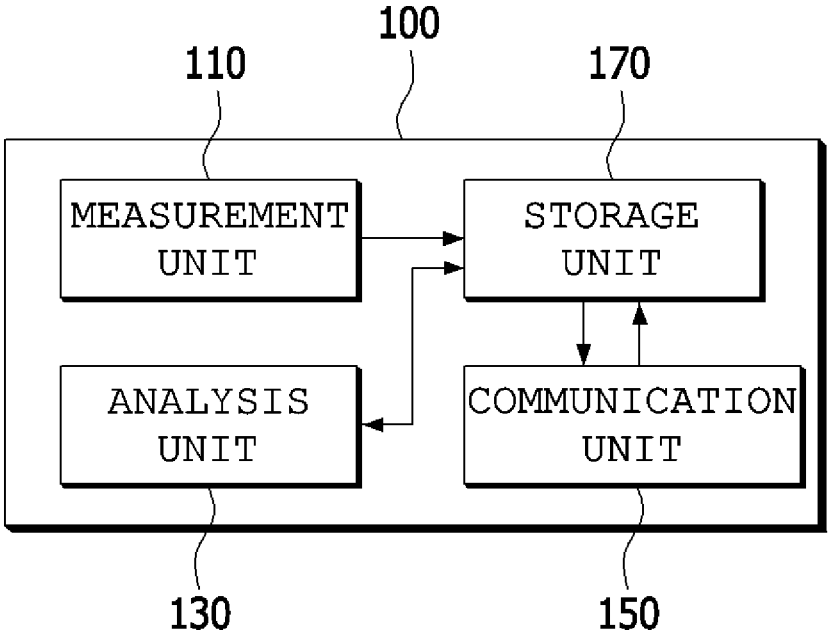
FIG. 2 is a functional block diagram illustrating a structure of the swing analysis device according to an embodiment of the present invention.

FIG. 2 is a functional block diagram illustrating a structure of the swing analysis device according to an embodiment of the present invention. Referring to FIG. 2, the swing analysis device 100 according to an embodiment of the present invention includes a measurement unit 110, an analysis unit 130, a communication unit 150, and a storage unit 170.

The measurement unit 110 of the swing analysis device 100 is configured to continuously measure motion data during swing motions of the golf club 10, and the measured motion data is stored in the storage unit 170.

The analysis unit 130 is configured to analyze the motion data measured by the measurement unit 110, thereby generating a swing analysis value such as a club head speed, a ball speed, a flying distance, a launching angle (launch angle of a ball), a ball flight (e.g., slice, hook, etc.), a movement trajectory of the ball and the like. The communication unit 150 transmits the swing analysis value generated by the analysis unit 130 to the user terminal 200.

Figure 3:
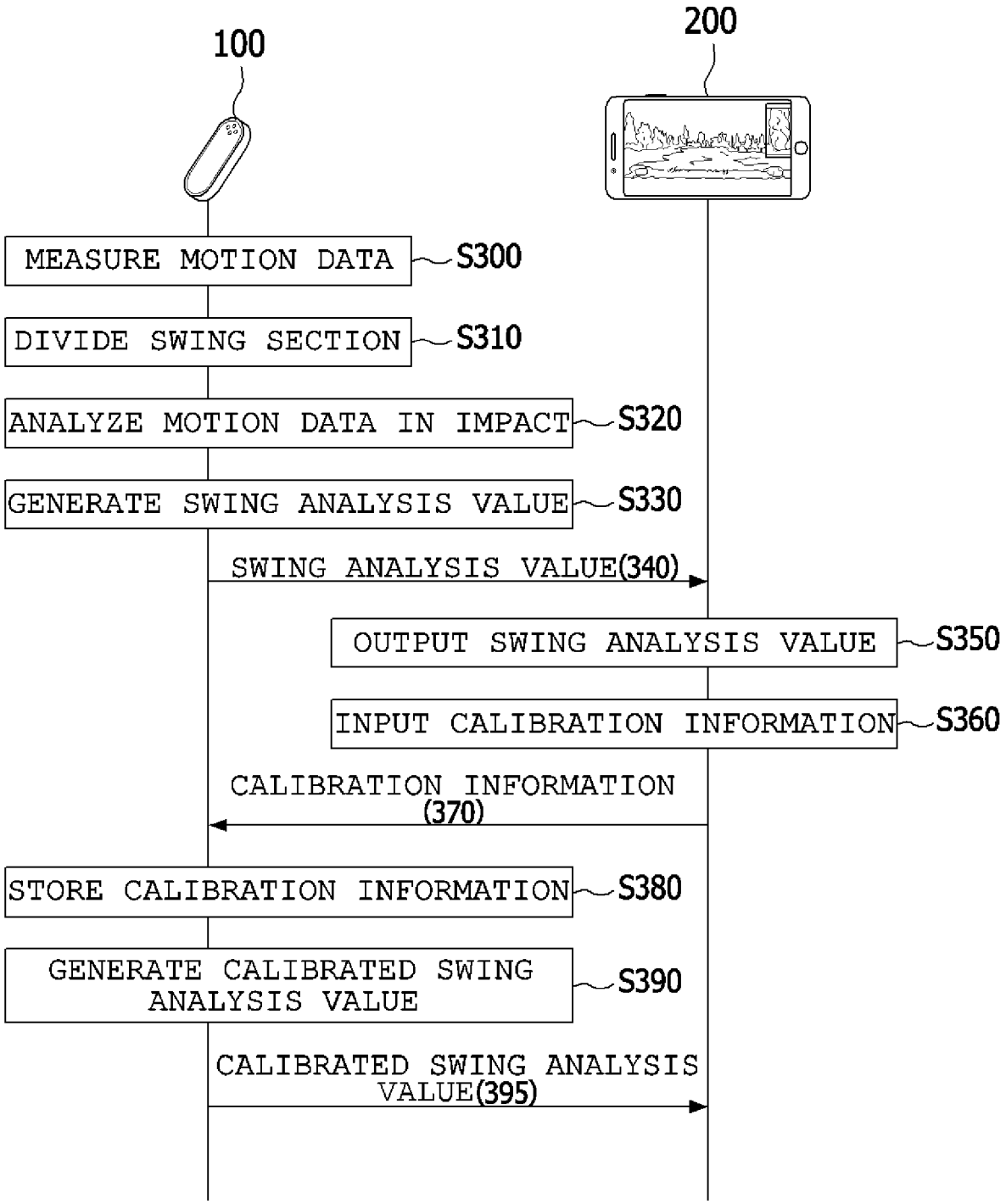
FIG. 3 is a signal flow diagram for describing an operation principle of the swing analysis device according to an embodiment of the present invention.

FIG. 3 is a signal flow diagram for describing an operation principle of the swing analysis device according to an embodiment of the present invention. Hereinafter, the operation principle of the swing analysis device 100 according to an embodiment of the present invention will be described with reference to FIGS. 1 to 3.

First, when the user performs a swing motion of the golf club 10 in a state in which the swing analysis device 100 according to the present invention is mounted on his/her own golf club 10, the measurement unit 110 of the swing analysis device 100 continuously measures the motion data of the golf club 10, and the measured motion data is stored in the storage unit 170 (S300).

Meanwhile, in carrying out the present invention, the measurement unit 110 of the swing analysis device 100 may include various sensors for measuring motion, such as a three-axis gyro sensor and an acceleration sensor, etc. Then, the analysis unit 130 of the swing analysis device 100 may detect a swing speed and a swing trajectory of the golf club 10 based on the motion data continuously measured by the sensors of the measurement unit 110.

Specifically, in the case of detecting the swing speed and the swing trajectory of the club 10 using values measured by sensors such as the 3-axis gyro sensor and the acceleration sensor, etc., a variety of known techniques may be used, such as a technique disclosed in Korean Patent Registration No. 10-818169 (a device and a method for measuring golf swing trajectory), etc., whereby the patent publication of Korean Patent Registration No. 10-818169 may be incorporated herein by forming a portion of the present disclosure.

Meanwhile, the analysis unit 130 of the swing analysis device 100 may divide the swing trajectory into an address section, a takeback section, a backswing section, a downswing section, an impact section, a follow-through section, and a finish section based on the detected swing speed information on each position in the swing trajectory, height information on each position in the swing trajectory, swing elapsed time information on each position in the swing trajectory and the like (S310).

For example, the analysis unit 130 of the swing analysis device 100 may divide a section having the lowest height in the swing trajectory and the highest speed in the swing trajectory as the impact section.

Meanwhile, the analysis unit 130 of the swing analysis device 100 analyzes the motion data in the impact section (S320), and thereby the swing analysis value such as the club head speed, the ball speed, the flying distance, the launching angle (launch angle of the ball), the ball flight (e.g., slice, hook, etc.), and the movement trajectory of the ball may be generated (S330).

Specifically, in carrying out the present invention, the analysis unit 130 of the swing analysis device 100 may generate the club head speed, the ball speed, the flying distance, the launching angle (launch angle of the ball), the ball flight (e.g., slice, hook, etc.), and movement trajectory information of the ball as the swing analysis value, based on the swing speed in the impact section, a slope in a vertical direction of the swing analysis device 100 (i.e., a vertical inclination angle of the club) in the impact section, a horizontal rotation angle of the swing analysis device 100 (i.e., a horizontal rotation angle of the club face) in the impact section.

Meanwhile, the communication unit 150 of the swing analysis device 100 transmits the swing analysis value to the user terminal 200 (S340), and then the application program installed in the user terminal 200 visualizes the swing analysis value received from the swing analysis device 100 in a form of various graphic images and outputs the images through a screen of the user terminal 200 (S350).

As described above, in the present invention, the swing analysis value directly generated by and received from the swing analysis device 100 can be output by the application program installed in the user terminal 200 without analyzing the motion data, thereby greatly improving the reaction speed of the application program.

Meanwhile, the user who has confirmed the swing analysis value output through the user terminal 200 as described above may input calibration information on the swing analysis value (S360).

Specifically, when the actual observed flying distance of the ball or the launch angle value measured more accurately through a separately installed radar tracking device is different from the swing analysis value of the swing analysis device 100, the user who hits the actual ball in a driving range or field through the swing motion of the golf club 10 in the above-described step S300 may input calibration information on the swing analysis value through the user terminal 200.

For example, when the user wants to calibrate the swing analysis value, the application program may activate a calibration information input window as the user selects the corresponding swing analysis value output on the touch screen of the user terminal 200. Thereby, the user may input the actual observed flying distance or the launch angle value measured more accurately through the separately installed radar tracking device into the user terminal 200.

Accordingly, the application program calculates an increase/decrease rate (e.g., +15%, −10%, etc.) of a value input by the user in the above-described step S360 compared to the swing analysis value in the above-described step S350, and the increase/decrease rate value calculated as described above may be transmitted to the swing analysis device 100 as calibration information on the swing analysis value.

Further, in carrying out the present invention, the user may directly input the increase/decrease rate of the swing analysis value for calibration of the swing analysis value as calibration information in the above-described step S360.

In addition, in carrying out the present invention, the user may input the calibration information by modifying the movement trajectory of the ball which is subjected to image processing and displayed on the touch screen of the user terminal 200 in a touch & drag method as shown in FIG. 1 in the above-described step S350.

For example, the user may adjust the movement trajectory of the ball in the touch & drag method so that a slice degree in the movement trajectory of the ball displayed on the touch screen of the user terminal 200 matches the slice degree of the actually struck ball. In this case, the application program may digitize an adjustment degree of the slice in the movement trajectory of the ball by the user by combining it with a sign (+/−) indicating an adjustment direction, thus to generate the calibration information.

Meanwhile, the calibration information received by the swing analysis device 100 through the communication unit 150 from the user terminal 200 is stored in the storage unit 170 of the swing analysis device 100 (S380), and then the analysis unit 130 may utilize the calibration information stored in the storage unit 170 when generating the swing analysis value of the user.

Meanwhile, in carrying out the present invention, the calibration information as described above may be divided and stored by user of a plurality of users who use the same swing analysis device 100 together, and may be utilized as necessary.

To this end, when the application program installed in the user terminal 200 is executed as the swing analysis device 100 is communicatively connected to the user terminal 200 by inputting an operation power of the swing analysis device 100 before the above-described step S300, the application program may activate an input window which allows the user to input user ID selection information (e.g., USER 1, USER 2, etc.).

Accordingly, as the user selects his/her ID, the application program may transmit the user ID selection information to the swing analysis device 100.

In this case, in the above-described step S380, the swing analysis device 100 may store the calibration information received from the user terminal 200 in association with the corresponding user ID.

Meanwhile, when the user selects his/her ID through the application program connected to the swing analysis device 100 by inputting the power of the swing analysis device 100, the swing analysis device 100 receives the user ID information from the application program.

Thereafter, as the user executes the swing motion of the golf club 10, the swing analysis device 100 generates a swing analysis value as in the above-described steps S300 to S330. Then, the analysis unit 130 of the swing analysis device 100 may perform calibration on the swing analysis value based on the calibration information stored in association with the corresponding user ID in the above-described step S380, thus to generate a calibrated swing analysis value (S390).

Specifically, when the calibration information on the flying distance of the ball stored in the above-described step S380 is +15%, the analysis unit 130 of the swing analysis device 100 may generate the calibrated swing analysis value by applying the corresponding increase/decrease rate value (+15%) to the swing analysis value generated as in the above-described steps S300 to S330.

Meanwhile, the user terminal 200 receives the calibrated swing analysis value as described above from the swing analysis device 100 (S395), and outputs it through the screen of the user terminal 200. As a result, the user may confirm a very accurate swing analysis value for his or her swing motion.

As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

While the present invention has been described with reference to the preferred embodiments and modified examples, the present invention is not limited to the above-described specific embodiments and the modified examples, and it will be understood by those skilled in the related art that various modifications and variations may be made therein without departing from the scope of the present invention as defined by the appended claims, as well as these modifications and variations should not be understood separately from the technical spirit and prospect of the present invention.

Description of Reference Numerals

10: Golf club
100: Swing analysis device
200: User terminal

What is claimed is:

1. A swing analysis device configured to be detachably installed on a golf club, the swing analysis device comprising:

a measurement unit which is coupled to the golf club, and is configured to continuously measure motion data during swing motions of the golf club;

an analysis unit configured to analyze the motion data continuously measured by the measurement unit to generate a swing analysis value which includes a club head speed, a flying distance of a ball, a launching angle of the ball, a ball flight, and a movement trajectory of the ball; and a communication unit configured to transmit the swing analysis value generated by the analysis unit to a user terminal, wherein the communication unit is configured to receive calibration information on the swing analysis value from the user terminal, the calibration information on the swing analysis value being input to the user terminal by a user who has confirmed the swing analysis value through the user terminal, wherein the swing analysis device further comprises a storage unit which is configured to store the calibration information, and wherein the analysis unit is configured to generate the swing analysis value based on the calibration information.

2. The swing analysis device according to claim 1, wherein the analysis unit divides the swing motion of the golf club into a plurality of swing sections based on the continuously measured motion data.

3. The swing analysis device according to claim 2, wherein the analysis unit analyzes the motion data in an impact section among the plurality of swing sections.

* * * * *